US009701367B2

(12) United States Patent
McDonough et al.

(10) Patent No.: US 9,701,367 B2
(45) Date of Patent: Jul. 11, 2017

(54) MODULAR WATERCRAFT

(71) Applicants: Robert J. McDonough, Bangor, ME (US); Geoffrey Michael Bergmark, Bangor, ME (US); Mathew Sewell Cardinali, Bangor, ME (US); Geoffrey P. King, Old Town, ME (US); Steven J. Zajicek, Greenbush, ME (US)

(72) Inventors: Robert J. McDonough, Bangor, ME (US); Geoffrey Michael Bergmark, Bangor, ME (US); Mathew Sewell Cardinali, Bangor, ME (US); Geoffrey P. King, Old Town, ME (US); Steven J. Zajicek, Greenbush, ME (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 14/745,586

(22) Filed: Jun. 22, 2015

(65) Prior Publication Data

US 2015/0367914 A1 Dec. 24, 2015

Related U.S. Application Data

(60) Provisional application No. 62/015,718, filed on Jun. 23, 2014.

(51) Int. Cl.
*B63B 17/00* (2006.01)
*B63B 35/00* (2006.01)
(Continued)

(52) U.S. Cl.
CPC ..... *B63B 7/04* (2013.01); *B63B 9/06* (2013.01); *B63B 35/71* (2013.01); *B63H 5/125* (2013.01);
(Continued)

(58) Field of Classification Search
CPC ..... B63B 7/04; B63B 9/06; B63B 2009/005; B63B 35/71; B63B 2035/71;
(Continued)

(56) References Cited

U.S. PATENT DOCUMENTS 6,022,249 A 2/2000 Ketterman
6,458,004 B2 * 10/2002 Van Breems ..... B63H 5/1252 440/54
(Continued)

FOREIGN PATENT DOCUMENTS

GB 2403461 A 1/2005

OTHER PUBLICATIONS

Lake George Kayak Co; Ultimate 14.5 Volt; internet printout accessed on Oct. 2, 2015; 2 pages; http://www.lakegeorgekayak.com/Native_kayaks_Ultimate_4.5_Volt_specs.htm.
(Continued)

*Primary Examiner* — Daniel V Venne
(74) *Attorney, Agent, or Firm* — Reinhart Boerner Van Deuren P.C.

(57) ABSTRACT

A watercraft system is provided. The watercraft system includes a hull and a plurality of removable pods. Each pod has a different operational characteristic to alter the configuration of the watercraft depending on which pod is inserted. The hull has a pod opening for receiving a selected one of the removable pods. A method and apparatus for transitioning various ones of the pods between different positions is also provided.

28 Claims, 17 Drawing Sheets

(51) Int. Cl.

| | |
|---|---|
| ***B63B 35/71*** | (2006.01) |
| ***B63H 21/17*** | (2006.01) |
| ***B63B 7/04*** | (2006.01) |
| ***B63B 9/06*** | (2006.01) |
| ***B63H 5/125*** | (2006.01) |
| ***B63H 16/18*** | (2006.01) |
| ***B63H 21/00*** | (2006.01) |
| *B60L 11/00* | (2006.01) |
| *B63B 9/00* | (2006.01) |

(52) U.S. Cl.
CPC ..... *B63H 16/18* (2013.01); *B63H 21/17* (2013.01); *B63H 21/24* (2013.01); *B63B 2009/005* (2013.01); *B63B 2035/715* (2013.01); *B63H 2005/1256* (2013.01); *B63H 2005/1258* (2013.01)

(58) Field of Classification Search
CPC .. B63B 2035/715; B63H 5/125; B63H 16/18; B63H 21/17
USPC ..... 114/343, 347, 364; 440/6
See application file for complete search history.

(56) References Cited

U.S. PATENT DOCUMENTS

| | | | | |
|---|---|---|---|---|
| 7,637,791 | B2 | 12/2009 | Ketterman et al. | |
| 7,887,381 | B2 * | 2/2011 | Brass | B63B 35/71 114/347 |
| 8,337,266 | B2 * | 12/2012 | Ellis | B63B 35/71 440/53 |
| 8,398,446 | B2 * | 3/2013 | Railey | B63B 35/79 440/6 |
| 9,150,295 | B2 * | 10/2015 | West | B63B 7/08 |
| 2005/0268833 | A1 * | 12/2005 | Conrad | B63B 7/082 114/55.5 |
| 2007/0012236 | A1 * | 1/2007 | Caples | B63B 19/16 114/347 |
| 2008/0299842 | A1 * | 12/2008 | Ellis | B63B 35/71 440/6 |
| 2009/0031941 | A1 | 2/2009 | Czarnowski et al. | |
| 2009/0042461 | A1 * | 2/2009 | Walton | B63H 5/125 440/6 |
| 2009/0311926 | A1 | 12/2009 | Ketterman et al. | |
| 2010/0162938 | A1 | 7/2010 | Halfon | |
| 2013/0059489 | A1 * | 3/2013 | Vlock | B63B 7/085 440/6 |

OTHER PUBLICATIONS ack.com; Ocean Kayak Torque Motorized Fishing Kayak; internet printout accessed on Oct. 2, 2015; 2 pages; http://www.austinkayak.com/products/14575/Ocean-Kayak-Torque-Motorized-Fishing-Kayak.html.

Hobie Evolve; Hobie evolve Control Unit; internet printout accessed on Oct. 2, 2015; 2 pages; http://www.hobiecat.com/accessories/evolve.

kayakfishingstuff.com; Ocean Kayak Torque; internet printout accessed on Oct. 2, 2015; 3 pages; http://www.kayakfishingstuff.com/drupal/content/ocean-kayak-torque.

Propel Drive, Native Watercraft; "Forward + Reverse = Fishing Success"; pages printed from the in internet; date last visited Oct. 2, 2015; 5 pages; http://www.firstwithreverse.com/propel-drive/.

Miragedrive: Hobie Cat; Mirage Drive with Glide Technology; pages printed from the internet; date last visited Oct. 2, 2015; 2 pages; http://www.hobiecat.com/mirage/miragedrive.

* cited by examiner

MODULAR WATERCRAFT

CROSS-REFERENCE TO RELATED PATENT APPLICATIONS

This patent application claims the benefit of U.S. Provisional Patent Application No. 62/015,718, filed Jun. 23, 2014, the entire teachings and disclosure of which are incorporated herein by reference thereto.

FIELD OF THE INVENTION

This invention generally relates to watercraft and more particularly to watercraft such as kayaks and canoes.

BACKGROUND OF THE INVENTION

Recreational watercraft such as kayaks have become increasingly popular for recreational activities. Kayakers have typically used a paddle to propel the kayaks. Unfortunately, many people cannot paddle a kayak for long distances or at all due to various physical conditions. Further, if a person is using the kayak to fish, paddling limits the usefulness of the kayak as the kayaker typically must use both hands to paddle the kayak and thus cannot hold the fishing pole.

Additionally, it has become very popular to fish from kayaks as a kayak can be maneuvered into many areas that a typical boat for fishing cannot, such as shallow water or heavy water vegetation. Due to the benefits of the maneuverability of the kayak many fisherman who would not otherwise use a kayak have become drawn to their use. Some of these fishermen would prefer a method to reduce the amount of paddling required to get to and from their fishing spot, but do not want to lose the shallow water capabilities of a traditional kayak.

Further, it is desired to avoid having to purchase a large number of kayaks for being able to perform various activities.

Embodiments of the present invention provide improvements over the current state of the art in recreational watercrafts.

BRIEF SUMMARY OF THE INVENTION

Embodiments of the present invention provide a modular recreational watercraft that can be configured for various different operational modes by swapping different removable pods.

In one embodiment, a modular watercraft in the form of a modular kayak including a hull and a plurality of removable pods is provided. The hull has a seating area and a pod opening extending through the hull. The hull includes a removable pod interface arrangement. The hull may be a single component or a plurality of components coupled together. The plurality of removable pods are configured to be mounted within the pod opening. Each removable pod has at least one functional feature different than the other removable pods. Each pod has a hull interface arrangement configured to cooperate with the removable pod interface arrangement to mount the removable pod within the pod opening.

In one embodiment, the plurality of removable pods includes an electric motor pod.

In one embodiment, an electric power source is located remote from the pod opening. An electric wiring system operably connects the electric power source to the electric motor pod. The electric wiring system includes, at least, a portion extending within the hull.

In one embodiment, the electric wiring system includes at least one releasable electrical connector between the electric power source and the electric motor pod to permit disconnecting and reconnecting the electric motor pod to the electric power source.

In one embodiment, the electric motor pod includes a propeller. The electric motor pod, when mounted in the pod opening, is transitionable between a first position and a second position thereby adjusting a position of the propeller with regard to a bottom of the hull.

In one embodiment, in the first position, the propeller extends bellow the bottom of the hull a further distance than in the second position. In some more particular embodiments, the propeller does not extend at all below the hull in the second position.

In one embodiment, the propeller is located within the pod opening in the second position and at least flush with a bottom surface of the bottom of the hull.

In one embodiment, a prop mechanism is interposed between the hull and the electric motor pod to secure the electric motor pod in the second position.

In one embodiment, the electric motor pod pivots between the first position and the second position.

In one embodiment, the pod opening is located in front of the seating location.

In one embodiment, the plurality of removable pods includes an electric motor pod including an electric motor with a propeller, a floor pod that has a top surface that generally aligns with a surrounding top surface of a floor of the hull, a pedal drive pod including a pedal drive arrangement for providing pedal powered propulsion, and a storage pod having an accessible internal cavity.

In one embodiment, the removable pod interface includes a pin receiving cavity and a hull interface arrangement of at least one of the removable pods includes an outward extending pivot pin configured to mate with the pin receiving cavity. The components define a pivoting interface therebetween to permit the at least one of the removable pods to pivot between a first position and a second position relative to the hull.

In one embodiment, a locking interface between the hull and the at least one of the removable pods is pivotable to selectively prevent pivoting motion of the removable pod relative to the hull from the first position to the second position. The removable pod being inserted further into the pod opening in a direction extending from a top of the hull toward a bottom of the hull in the first position than in the second position.

In one embodiment, the pod opening is generally elongated in a direction between a front and a rear of the hull. The pod opening further includes a laterally extending recess on at least on side.

In one embodiment, the hull includes a stepped interface adjacent the pod opening and at least one of the removable pods includes a cooperating stepped interface that interacts with the stepped interface of the hull when the removable pod is inserted within the pod opening. The interaction of the stepped interfaces inhibits water from passing through the pod opening between the hull and the removable pod.

In another embodiment, a method of converting a kayak is provided. The method includes removing a first pod having from a pod opening of a hull of the kayak, the pod opening being forward of a seating area of the kayak and securing a second pod in the pod opening of the hull, the second pod being different than the first pod.

In one embodiment, the second pod is an electric motor pod. The step of securing includes operably connecting the electric motor pod to a power supply remote from the pod opening via an electrical wiring system. The wiring system includes a releasable connector for selectively disconnecting and reconnecting the electric motor pod from the power supply.

In another embodiment, a method of adjusting a position of a propulsion pod of a kayak is provided. The method includes transitioning the propulsion pod of the kayak from a first position wherein a propulsion mechanism is located, at least in part, below a bottom surface of a bottom of a hull of the kayak to a second position wherein the propulsion mechanism is at least flush with and above the bottom surface of the bottom of the hull.

In one embodiment, the propulsion mechanism is a rotating propeller.

In one embodiment, the method includes securing the propulsion pod in the second position using a prop extending between the propulsion pod and the hull.

In one embodiment, the step of transitioning includes pivoting the propulsion pod from the first position to the second position prior to the step of securing the propulsion pod in the second position.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
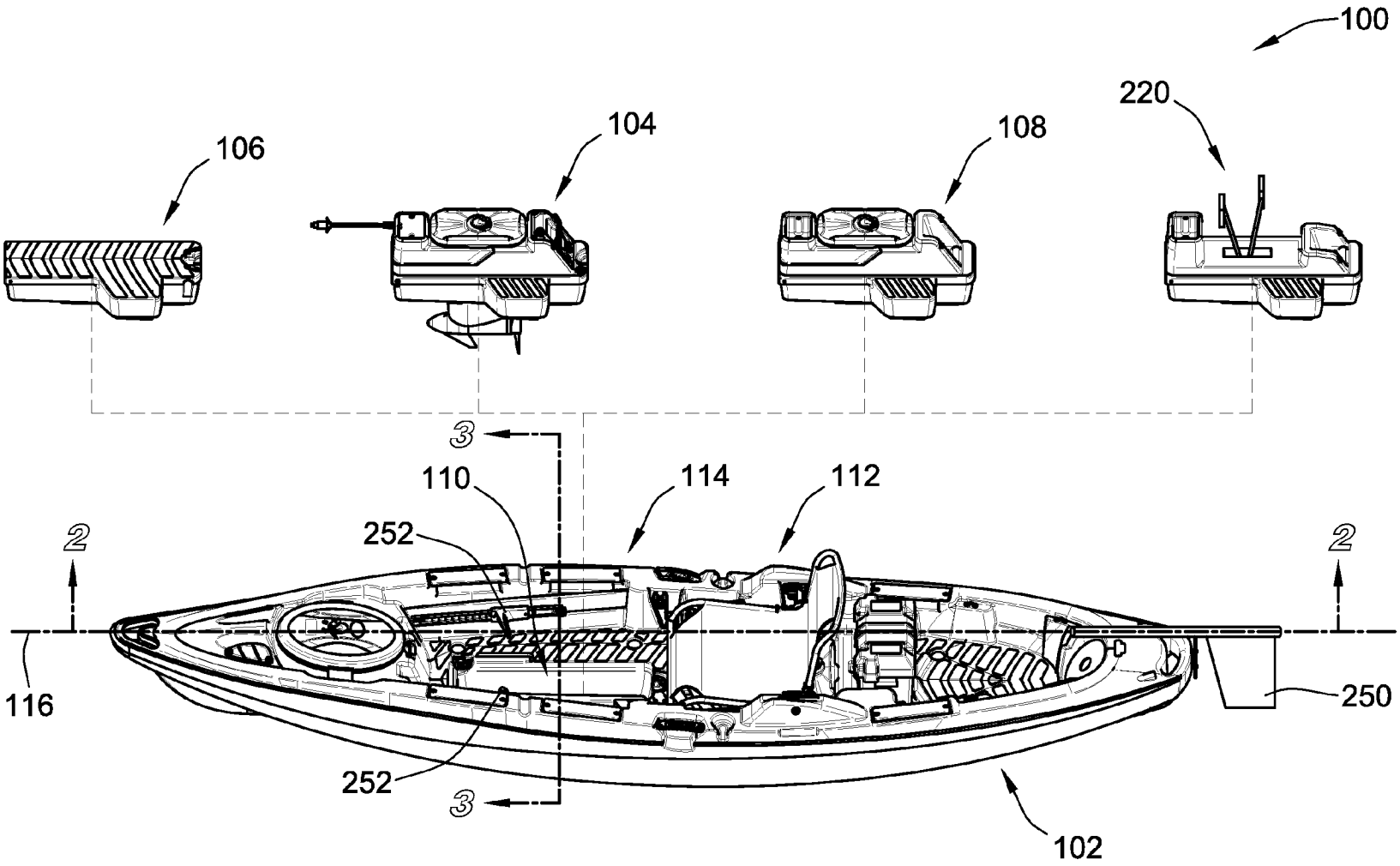
FIG. 1 is a top perspective illustration of a watercraft system according to an embodiment of the present invention.

FIG. 1 illustrates an embodiment of a modular recreational watercraft system illustrated in the form of a modular kayak system 100 (also referred to simply as a "modular kayak 100"). The modular kayak system 100 includes a hull assembly 102 (also referred to simply as a "hull 102") and a plurality of removable pods (including an electric motor pod 104, a floor pod 106 and a storage pod 108) selectively attachable to the hull assembly 102 to modify the functionality and options of the kayak while in use on the water. While three removable pods are illustrated, alternative removable pods are contemplated including a pedal drive pod that allows for pedal propulsion.

Typically, at least in a kayak, the hull assembly 102 will be a hollow body that may be rotomolded, vacuum formed, or otherwise formed.

Figure 2:
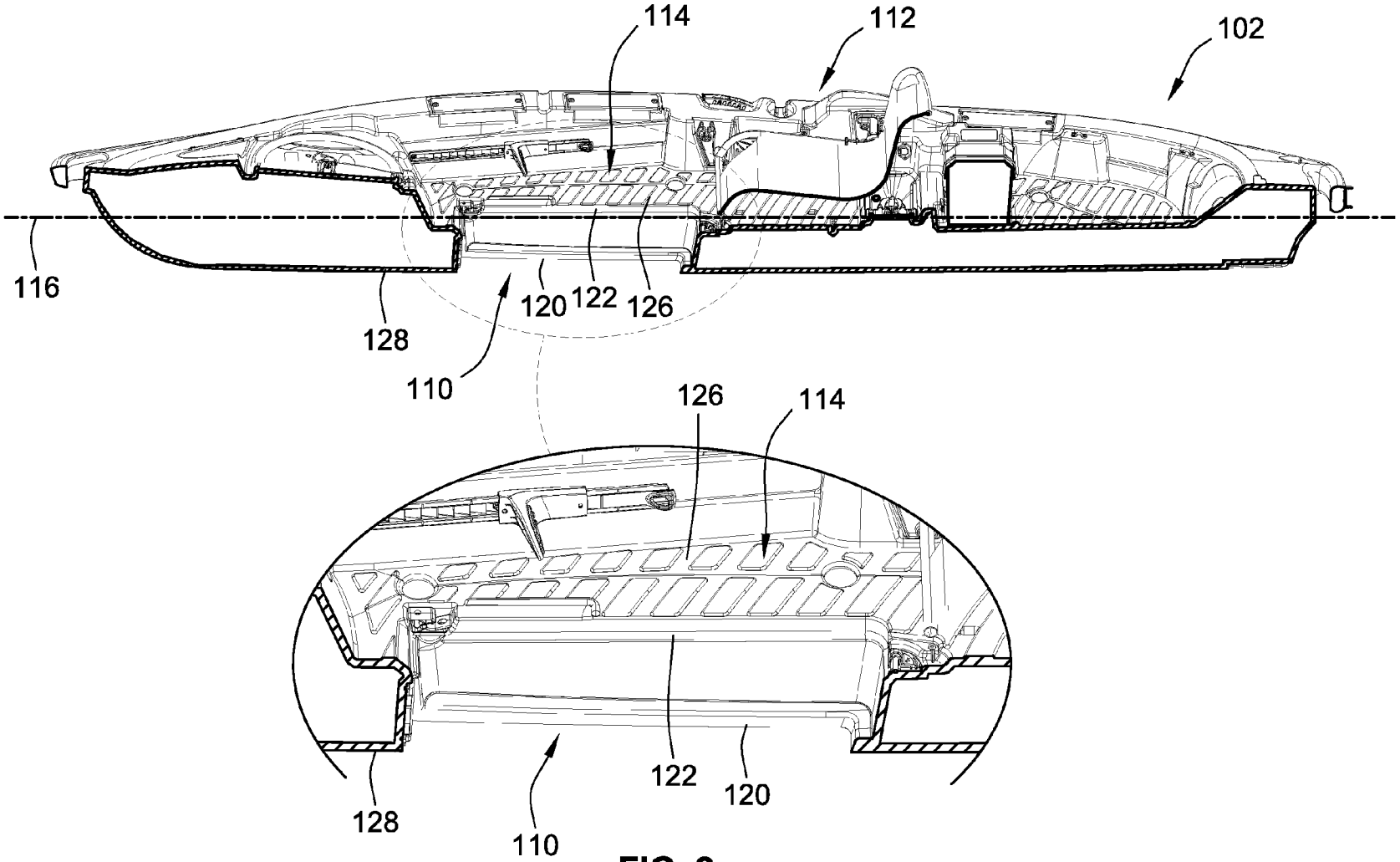
FIG. 2 is a cross-sectional illustration of the hull assembly of the watercraft system of FIG. 1 taken about line 2-2 of FIG. 1.
Figure 3:
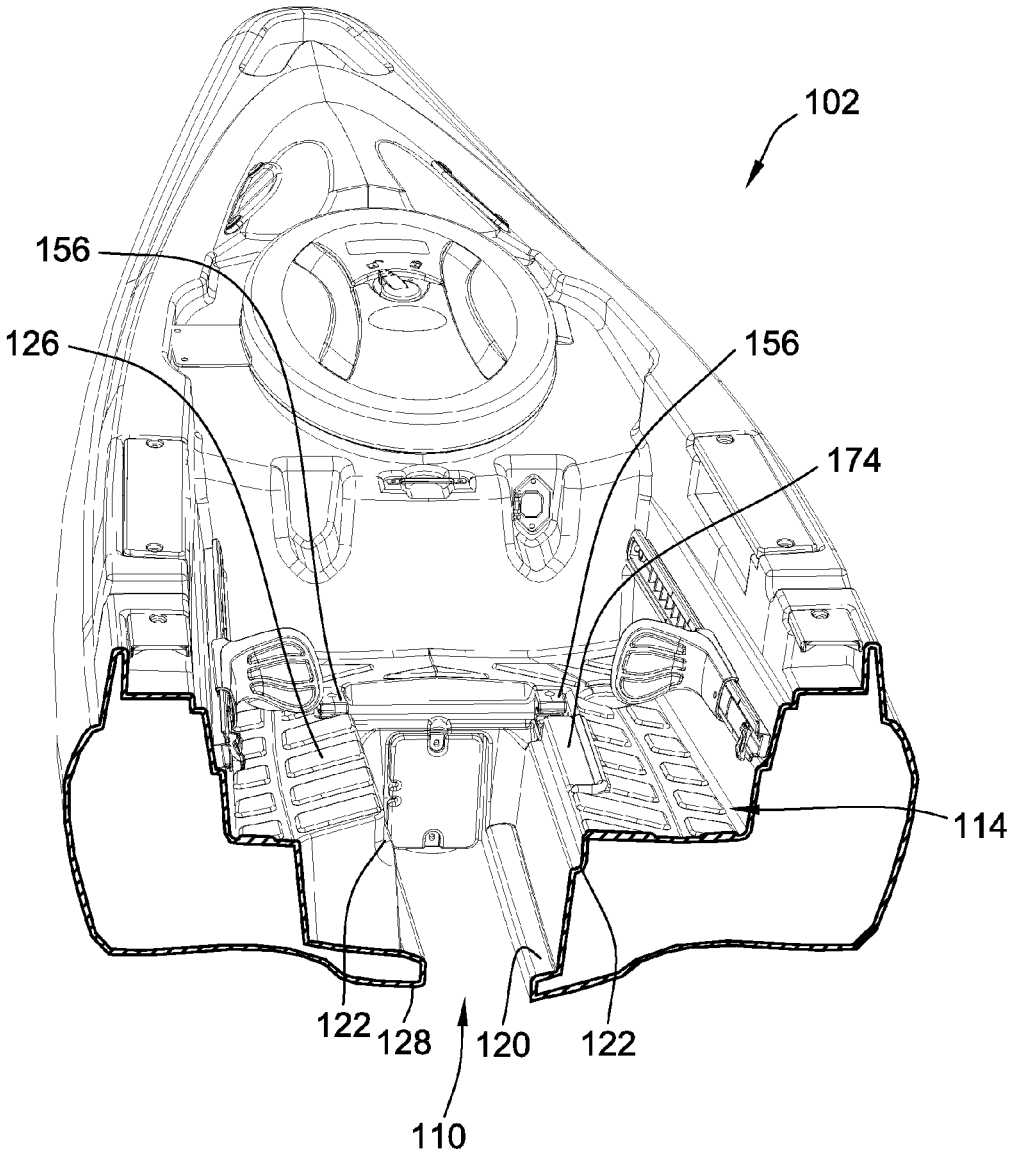
FIG. 3 is a cross-sectional illustration of the hull assembly of the watercraft system of FIG. 1 taken about line 3-3 of FIG. 1.

The removable pods 104, 106, 108 are removably mounted to the hull assembly 102 within a pod opening 110. The pod opening 110 is positioned forward of a seat area 112 within a floor or standing section 114 of the hull assembly 102. With additional reference to FIGS. 2 and 3, the pod opening 110 extends entirely through the floor section 114 forward of the seat area 112. As such, the pod opening 110 is a hole that extends through the hull assembly 102. More particularly, the pod opening 110 will extend through a top surface of the floor section 114 and a bottom surface of the hull assembly 102.

The floor section 114 forward of the seat area 112 is generally where a user will stand, such as while fishing, or where the user's feet/legs will be positioned while paddling.

Figure 4:
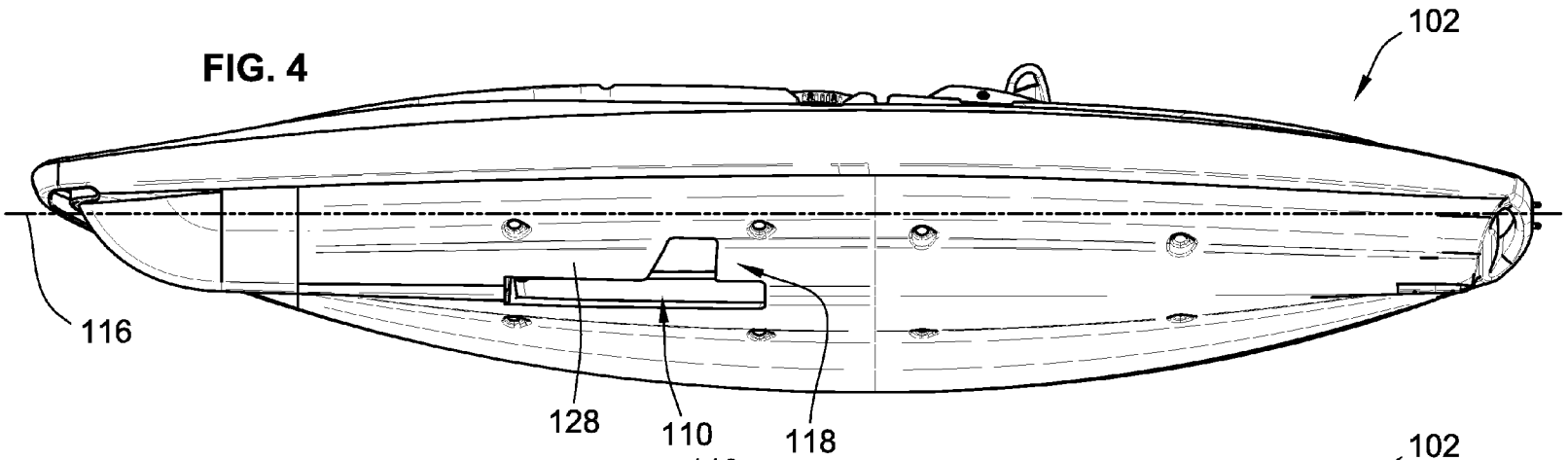
FIG. 4 is a bottom view of the hull assembly of FIG. 1 without any removable pods mounted therein.
Figure 5:
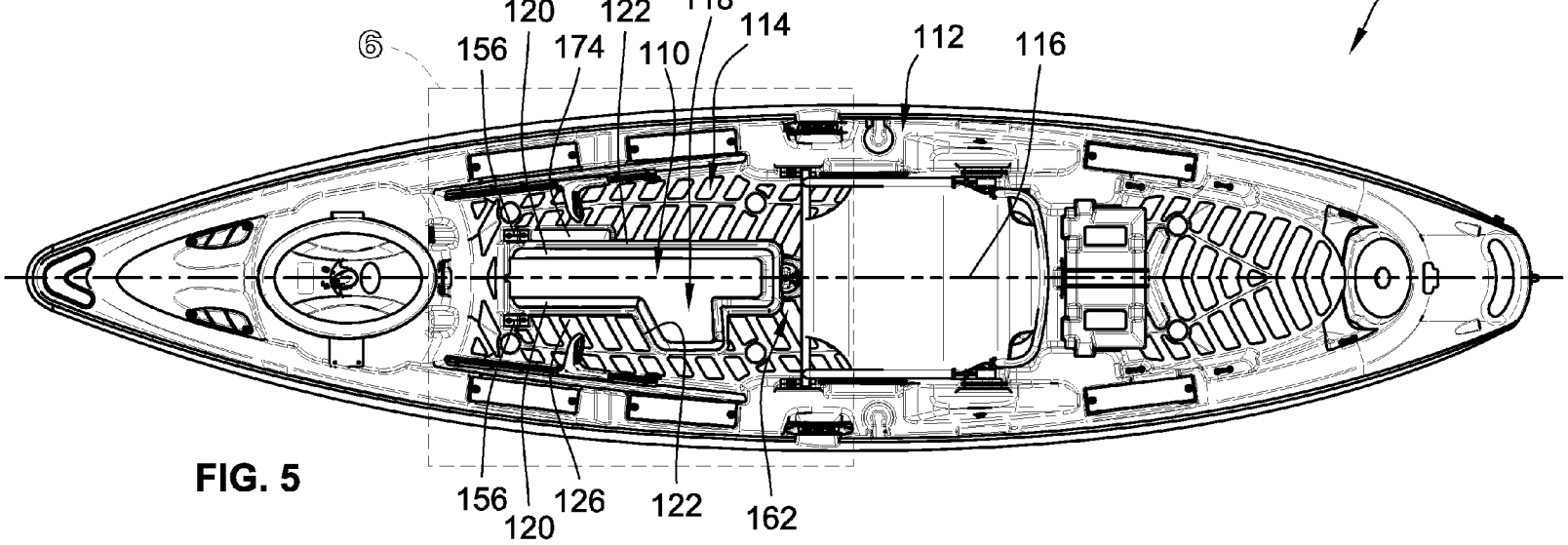
FIG. 5 a top view of the hull assembly of FIG. 1 without any removable pods mounted therein.
Figure 6:
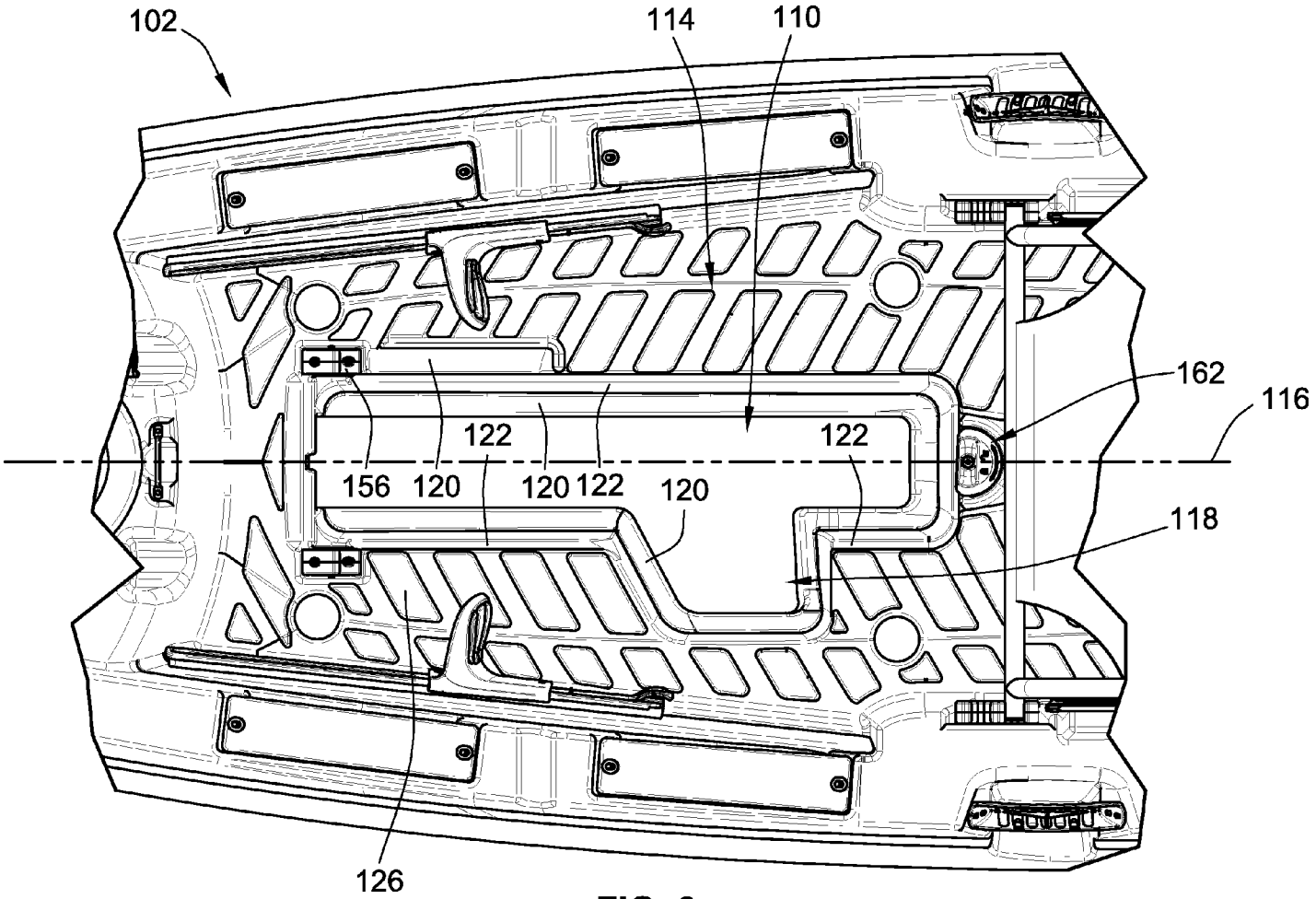
FIG. 6 is an enlarge top view of the foot area of the hull assembly of FIG. 1 illustrating the pod opening extending therethrough.

FIGS. 4-6 further illustrate the hull assembly 102 without any removable pod mounted within the pod opening 110. In the illustrated embodiment, the pod opening 110 is generally elongated along the fore-aft axis 116 of the hull assembly 102. The pod opening 110 includes a recessed pocket or laterally formed cut expanded region 118 configured to accommodate mounting and removal of removable pods, and particularly, removable pods, such as the electric motor pod 104, configured to provide propulsion mechanisms.

Each removable pod will generally be shaped and sized to mate with the cross-sectional shape of the pod opening 110.

With principle reference to FIGS. 2, 3, 5 and 6, the hull assembly 102 includes a plurality of inward extending shelf portions 120, 122. These shelf portions 120, 122 provide stepped features in the sidewalls that define, at least in part, the pod opening 110. The shelf portions 120, 122 also provide axially upward facing surfaces against which corresponding stepped surfaces or shelves of a removable pod will abut when installed. These shelves 120, 122 prevent the removable pods from passing straight through the pod opening 110. The stepped interface between the hull assembly 102 and the removable pods also inhibits the ingress of water into the floor area 114 of the hull assembly 102. Generally, the sidewalls bounding the pod opening 110 will also include a slight inward taper (when moving from the top surface 126 toward the bottom surface 128) to further facilitate insertion and mounting of the removable pods within the pod opening 110.

Figure 7:
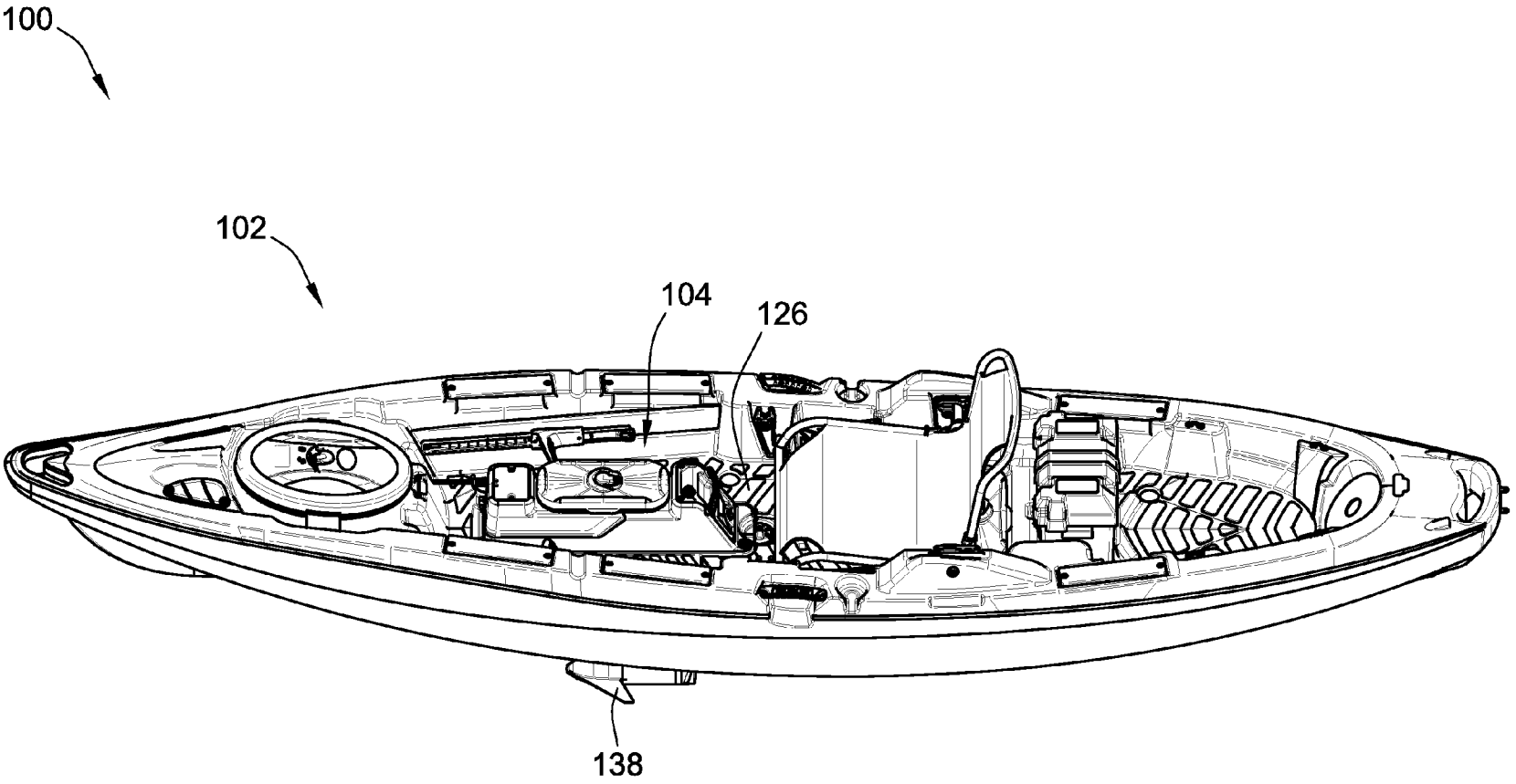
FIG. 7 is a top perspective illustration of the watercraft of FIG. 1 having the electric motor pod mounted in the hull assembly.
Figure 8:
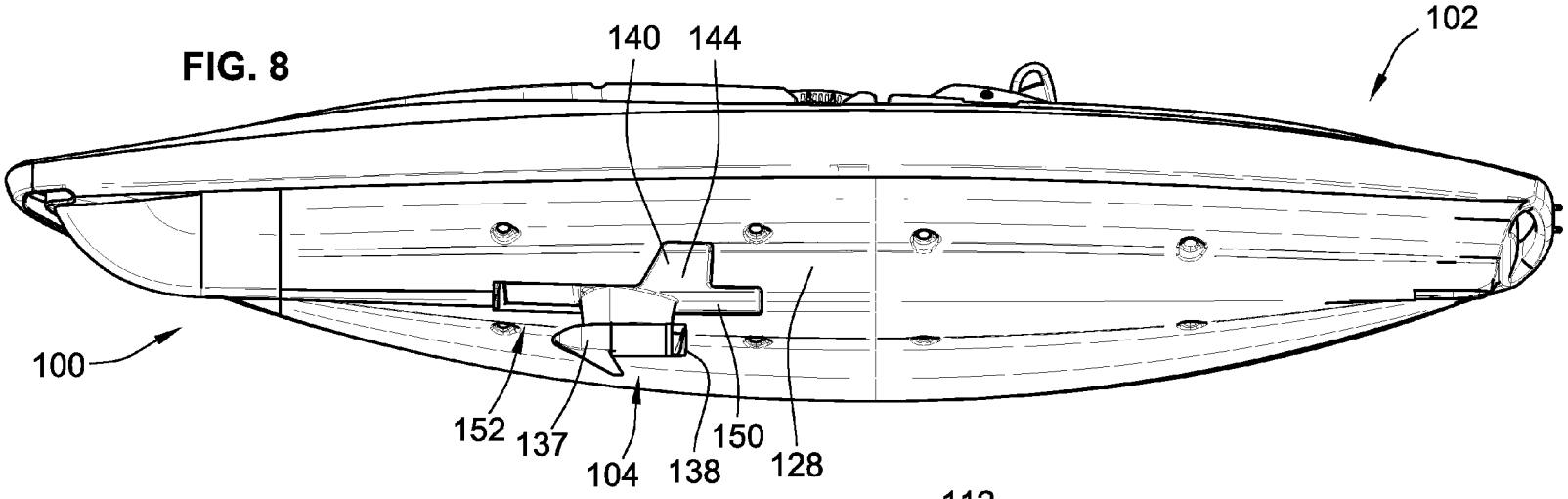
FIG. 8 is a bottom perspective illustration of the watercraft of FIG. 1 having the electric motor pod mounted in the hull assembly.
Figure 9:
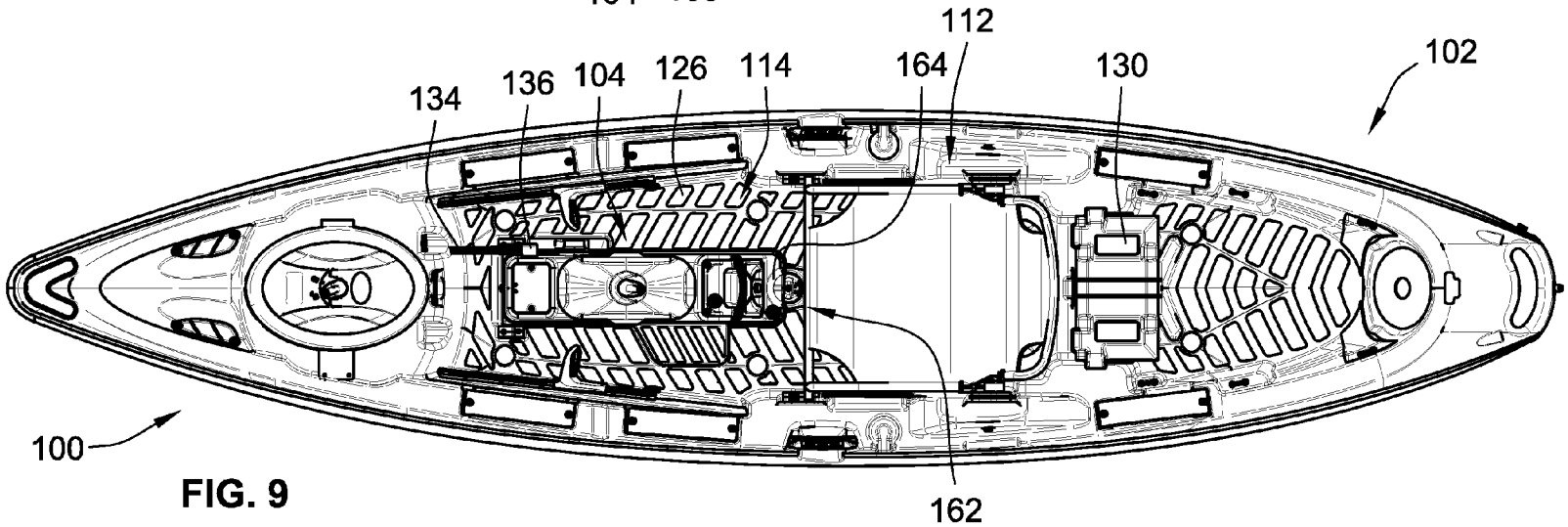
FIG. 9 is an enlarged top illustration of the watercraft of FIG. 1 having the electric motor pod mounted in the hull assembly.

FIGS. 7-9 illustrate the electric motor pod 104 mounted within the pod opening 110. A power supply 130 (typically a battery) is mounted rearward of the seat area 112. An electrical system 134 releasably operably electrically connects the electric motor pod 104 to the power supply 130. Preferably, a portion of the electrical system 134 runs within the interior of the hull assembly 102. Additionally, a connector 136 is preferably interposed between the electric motor pod 104 and the power supply 130 to facilitate easy removal of the electric motor pod 104 from the hull assembly 102. Further connectors may be provided between the power supply 130 and the electrical system 134 to facilitate removal of the power supply 130 from the hull assembly 102.

The electric motor pod 104 provides propulsion to the kayak using an electric motor 137 and a propeller 138 (see e.g. FIGS. 7, 8, 10 and 11). Additional electric components such as speed control, circuit breaker, or emergency kill switch may be included in the system.

Figure 10:
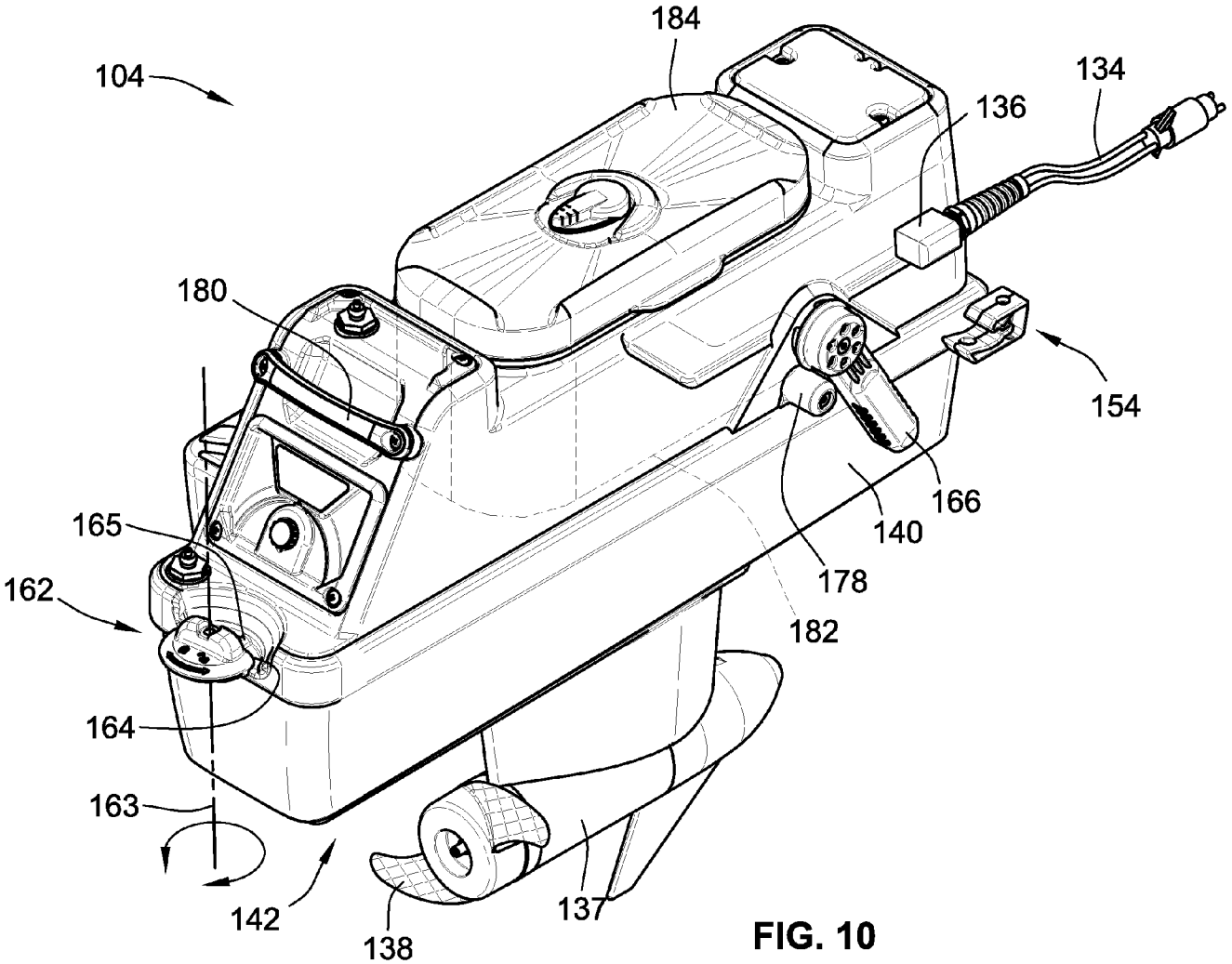
FIG. 10 is a top perspective illustration of the electric motor pod of the watercraft system including additional mounting features of the watercraft system for securing the electric motor pod to the hull assembly.
Figure 11:
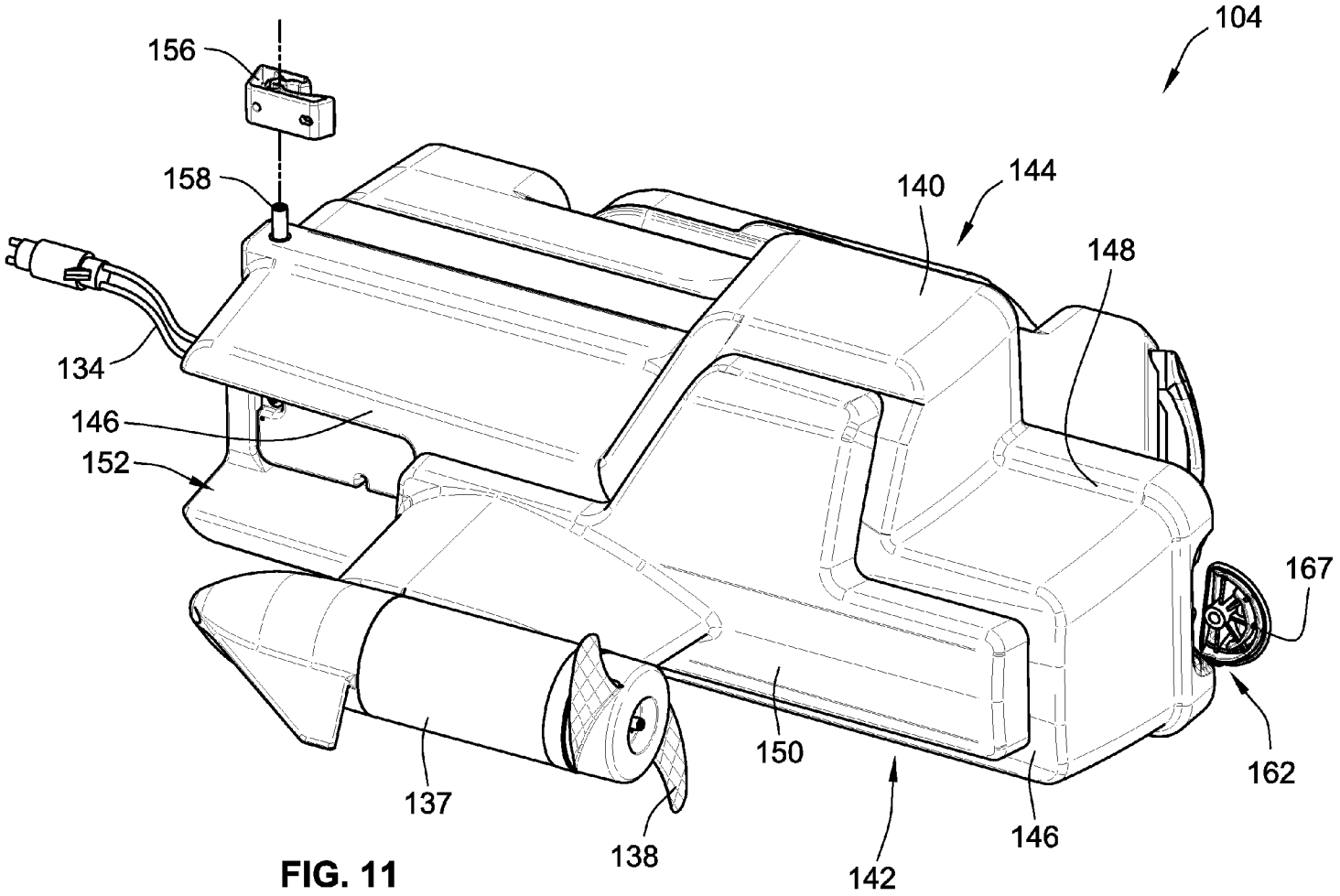
FIG. 11 is a bottom perspective illustration of FIG. 10.

With reference to FIGS. 10 and 11, the electric motor pod 104 includes a housing 140 that is sized and shaped to be inserted within the pod opening 110 of the hull assembly 102. More particularly, the housing has an elongated central region 142 and a laterally extending projection portion 144. The projection portion 144 will mate with recess 118 when mounted within the pod opening 110.

Additionally, the housing 140 defines first and second shelf portions 146, 148 that interface with shelves 120, 122 when the electric motor pod 104 is fully mounted in the pod opening 110. The first and second shelf portions 146, 148 define stepped profiles within the sidewalls of the housing 140. As noted above, the interface between or cooperation of the stepped configuration of the sidewalls of the hull assembly 102 and the sidewalls of the housing 140 help inhibit the ingress of water into the watercraft.

The interaction between the shelves 120, 122, 146, 148 also helps locate and seat the housing 140 within the pod opening 110.

A bottom side of the housing 140 includes a hull bottom portion 150. The hull bottom portion 150 is configured to match with the bottom surface 128 of the hull assembly 102, such as if the pod opening 110 did not exist. This hull bottom portion 150 is rearward of the electric motor 137. The hull bottom portion 150 also includes at least part of the projection portion 144.

With reference to FIGS. 8 and 11, the bottom of the housing 140 includes a recessed cavity 152 that is forward of the electric motor 137 or at least forward of the propeller 138. The recessed cavity 152 provides a location for a depth finder or fish finder transducer or other sensor to be located.

Figure 12:
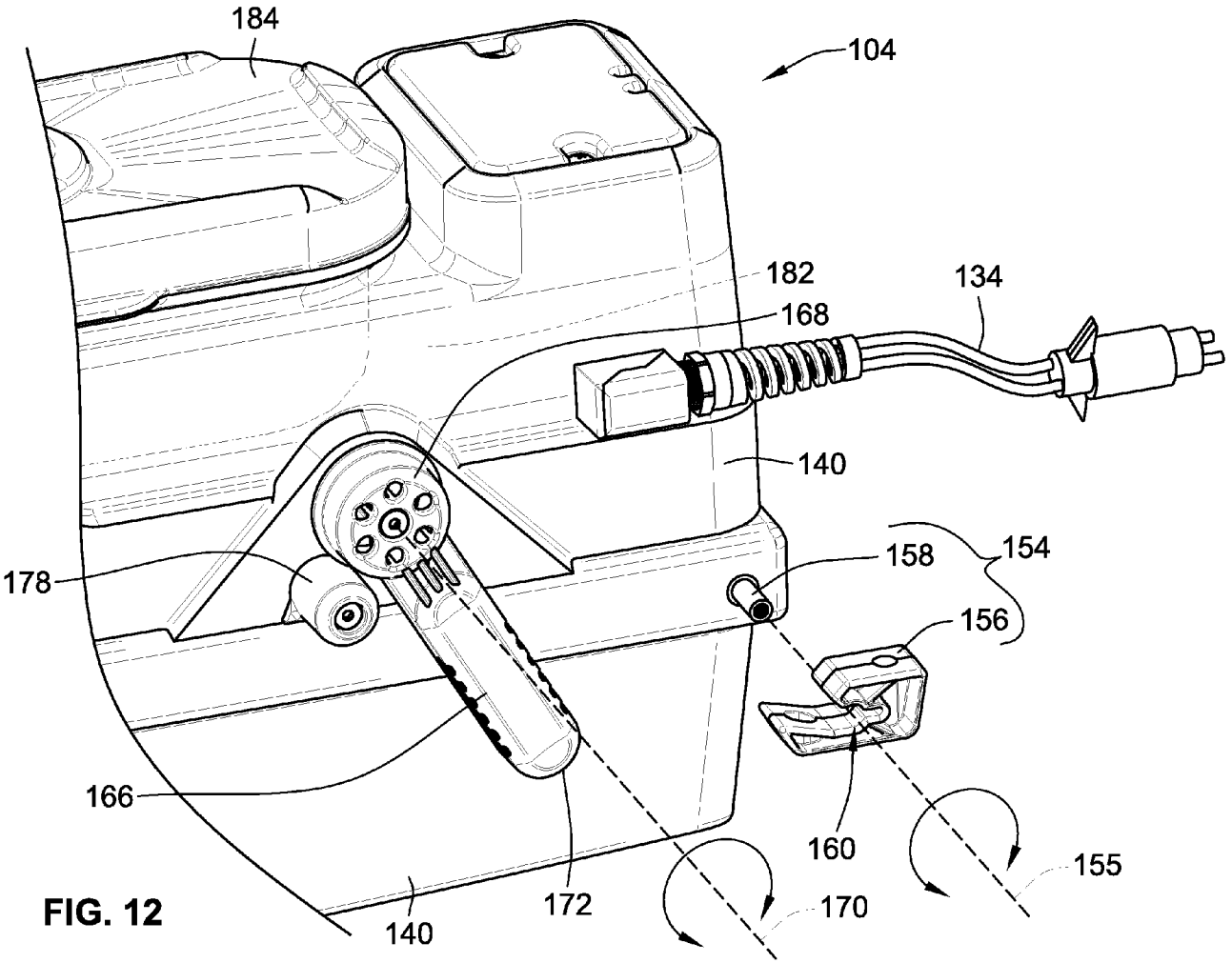
FIG. 12 is an enlarged and partially explode illustration of the electric motor pod and the clip retainer for mounting the electric motor pod to the hull assembly.

The electric motor pod 104 is releasably mountable within the pod opening 110. With reference to FIG. 12, a portion of an interface 154 between the hull assembly 102 and the electric motor pod 104 is shown in exploded form. The interface 154 provides a hinged arrangement that permits the electric motor pod 104 to pivot relative to the hull assembly 102.

In this embodiment, the interface 154 includes a removable pod interface arrangement that includes, at least, a pair of pin retainers 156 (one on each side of the pod opening (see FIG. 3)) and a hull interface arrangement that includes a pair of cooperating pins 158 (one on each side of the electric motor pod 104 (see FIGS. 11 and 12).

The pin retainers 156 are removably attached components removably attached to the floor area 114. However, in other embodiments, they could be directly molded into the rest of the hull assembly 102. The pin retainers 156 define slots 160 that define open mouths that face rearward toward the seat area 112 of the watercraft. The slots 160 are sized and configured to receive pins 158.

When mounting the electric motor pod 104, the pod may be inserted into the pod opening 110 at an angle and then rotated to a fully mounted position.

Figure 13:
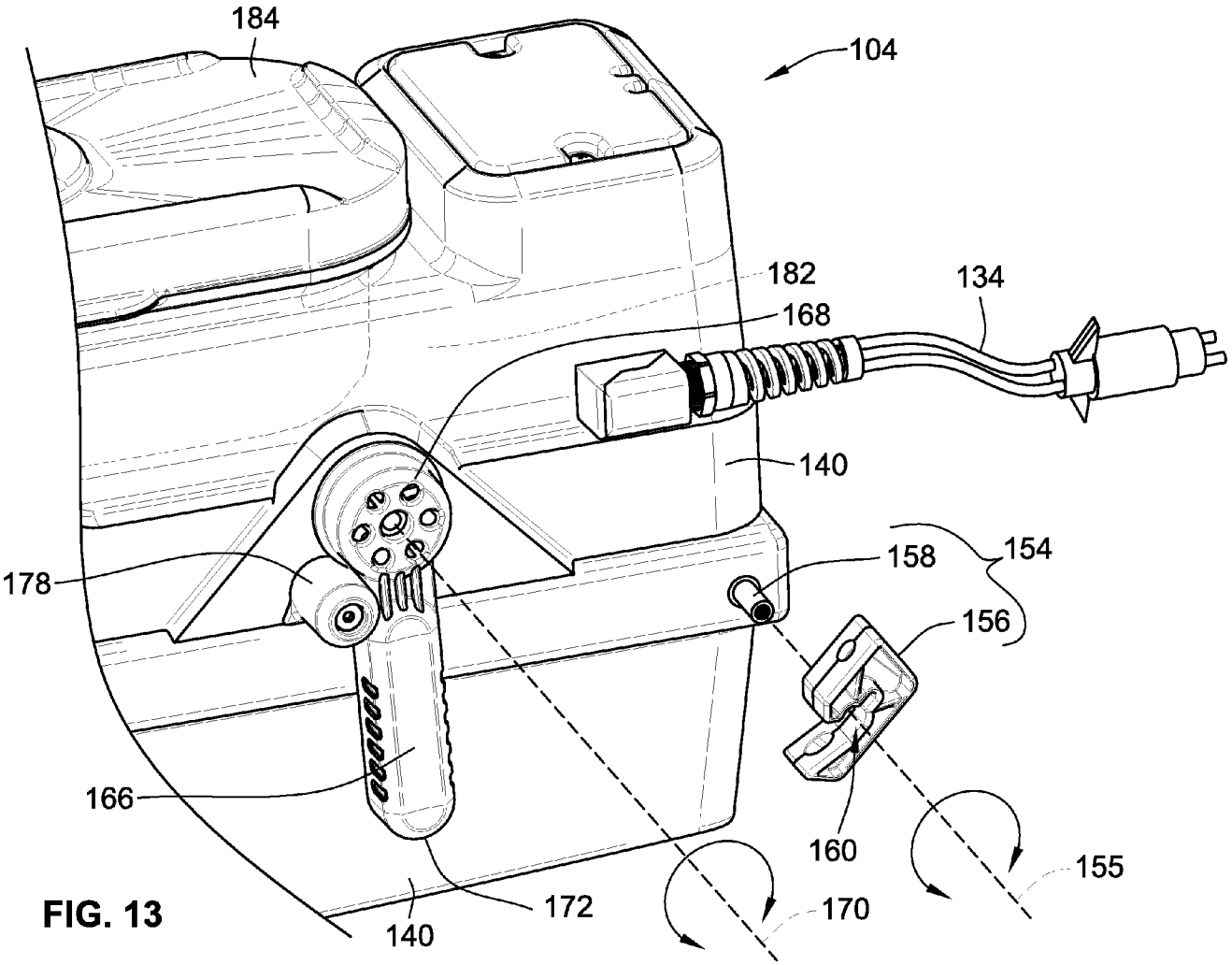
FIG. 13 is similar to FIG. 12 having the electric motor pod rotated into a second position relative to the clip retainer and having the prop positioned to secure the electric motor pod in an up position (or landing position)

To facilitate use of the kayak in shallow water or while approaching shore, the electric motor pod 104 is transitionable, and more particularly pivotable, between first and second positions through the interface 154 about axis 155 (see FIGS. 12 and 13). The first position would be fully inserted or mounted position where the electric motor 137 and propeller are located within the water when the kayak is in the water. Preferably, in the first position, the propeller extends, at least in part, below the bottom surface 128 of the hull assembly. More preferably, the propeller 138 is entirely below the hull assembly 102 when in the first position so as to maximize the amount of propulsion provided by the electric motor pod 104.

FIGS. 7 and 8 illustrate the electric motor pod 104 in the first position.

Figure 14:
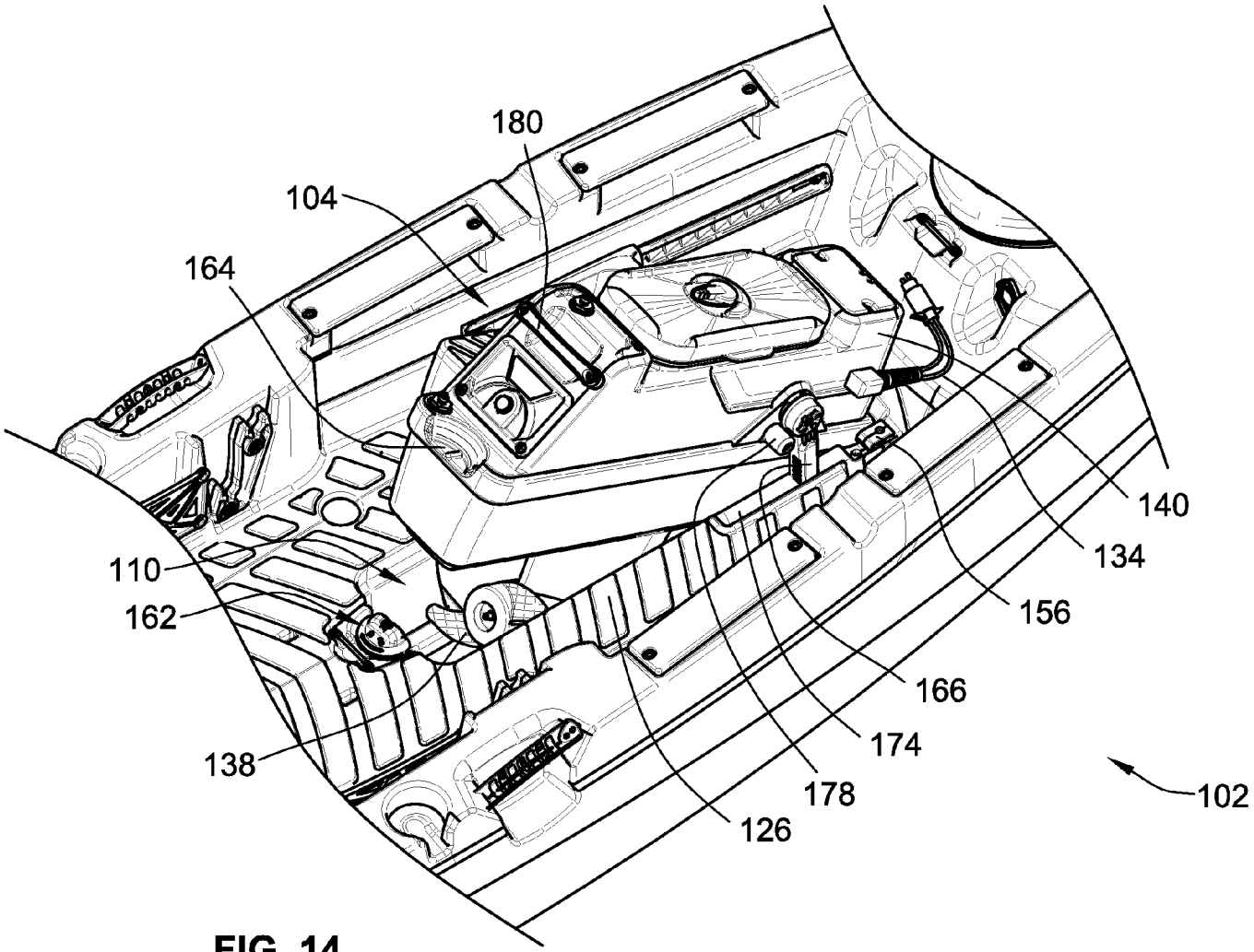
FIG. 14 illustrates the electric motor pod in the landing position relative to the hull assembly.

In the second position (also referred to as an "up position" or a "landing position"), see e.g. FIG. 14, the propeller 138 is preferably drawn up into the pod opening 110 and that propeller is above the bottom surface 128 of the hull assembly 102. At most, the propeller may become flush with the bottom surface 128 of the hull assembly 102. In this position, the propeller is protected from being damages in shallow waters.

Recess 118 of the pod opening 110 helps facilitate transitioning the electric motor pod 104 to the second position. The recess 118 accommodates a blade of the propeller 138 if the blades extend perpendicular to a vertical axis, i.e. on opposite sides of the fore-aft axis 116 such that they would have a dimension from tip-to-tip that would be greater than the width of the pod opening. During the transition, one of the propeller's blades may hit the bottom surface 128 of the hull assembly 102 opposite recess 118 causing the propeller 138 to rotate. The other free blade will pass through recess 118 and allow the electric motor pod 104 to continue to transition upward and toward the second position.

Interface 154 is located proximate a forward end of the pod opening 110 to secure a first end of the housing 140 within the pod opening 110. Proximate a rearward end of the pod opening 110, a latch arrangement 162 is provided that selectively engages the housing 140 of the electric motor pod 104 to secure the opposite end of the housing 140 in within the pod opening 140. When engaged with the housing 140 of the electric motor pod 104, the latch arrangement 162 prevents the electric motor pod 104 from pivoting about axis 155 from the first position to the second position. Latch arrangement 162 rotates about axis 163 to selectively engage the housing 140.

The housing includes a cooperating abutment in the form of shelf portion 164 over which the latch arrangement 162 extends when the latch arrangement 162 is in a locked state. In the unlocked state, the shelf portion 164 is free of latch arrangement 162. The shelf portion 164 includes a rib 165 that cooperates with a corresponding groove 167 in the bottom of the latch arrangement 162 to prevent unintentional unlocking of the electric motor pod 104.

In alternative embodiments, the groove and rib could be reversed. Further, alternative locking arrangements could be provided.

To secure the electric motor pod 104 in the second position, a prop 166 is pivotally connected to housing 140. The prop 166 is pivotally connected to the housing 140 at a first end 168 for rotation about axis 170. Opposite the first end 168, the prop 160 has a distal free end 172. The distal free end 172 will press against a contact zone 174 of the hull assembly 102 (see FIGS. 3, 5 and 6) to secure the electric motor pod 104 in the second position.

An abutment 178 extends outward from housing 140 and prevents over rotation of the prop 166 when it is transitioned to a position to secure the electric motor pod 104 in the second position. When the prop 166 transitions from its first position (FIG. 12) when the electric motor pod 104 is in its fully inserted position (the first position) to its second position (FIG. 13) when the electric motor pod 104 is in its second position (a retracted position), the prop 166, and particularly distal end 172, will transition through an over-center state such that the weight of the electric motor pod 104 in the second position will not bias the prop 166 back toward the first position (FIG. 12). Instead, the user must lift the electric motor pod 104 and then transition the prop 166 back toward the position in FIG. 12 before transitioning the electric motor pod from the second position back to the first position.

The electric motor pod 104 includes a handle 180. Handle 180 assists a user when transition the electric motor pod 104 between the first and second positions as well as provides a handhold for the user when attempting standup or sit down in the watercraft.

The electric motor pod 104 in this embodiment also includes a storage compartment 182 which is accessible through cover 184.

Figure 15:
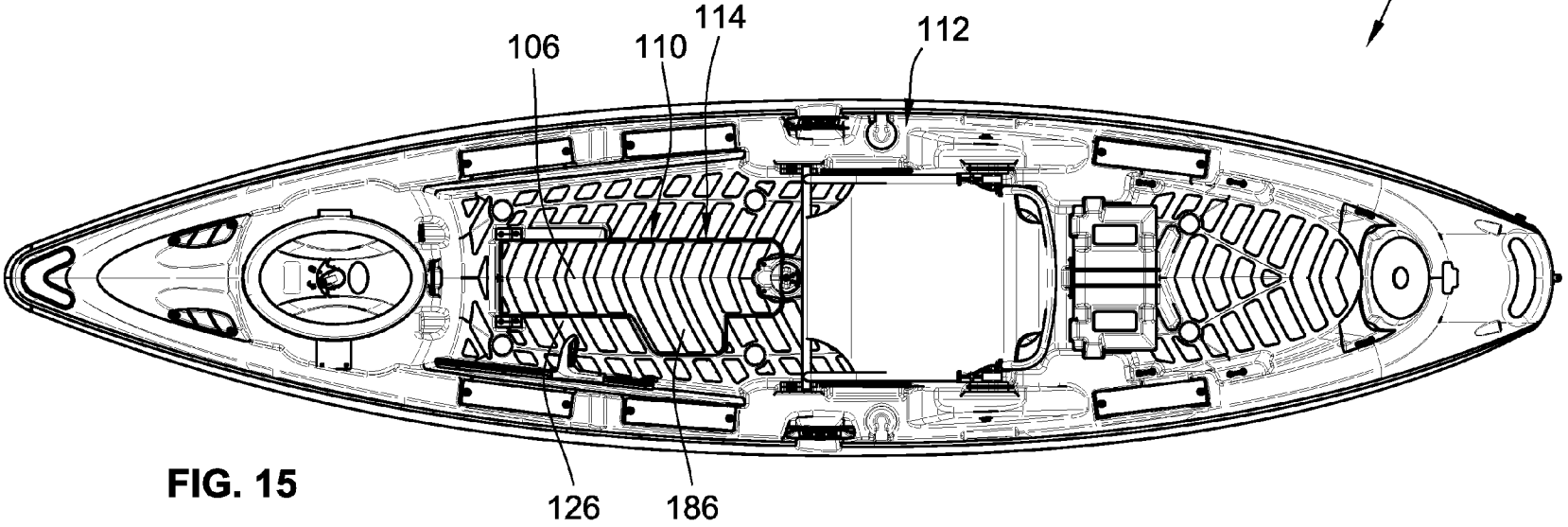
FIG. 15 a top perspective illustration of the watercraft of FIG. 1 having the floor pod mounted in the hull assembly.
Figure 17:
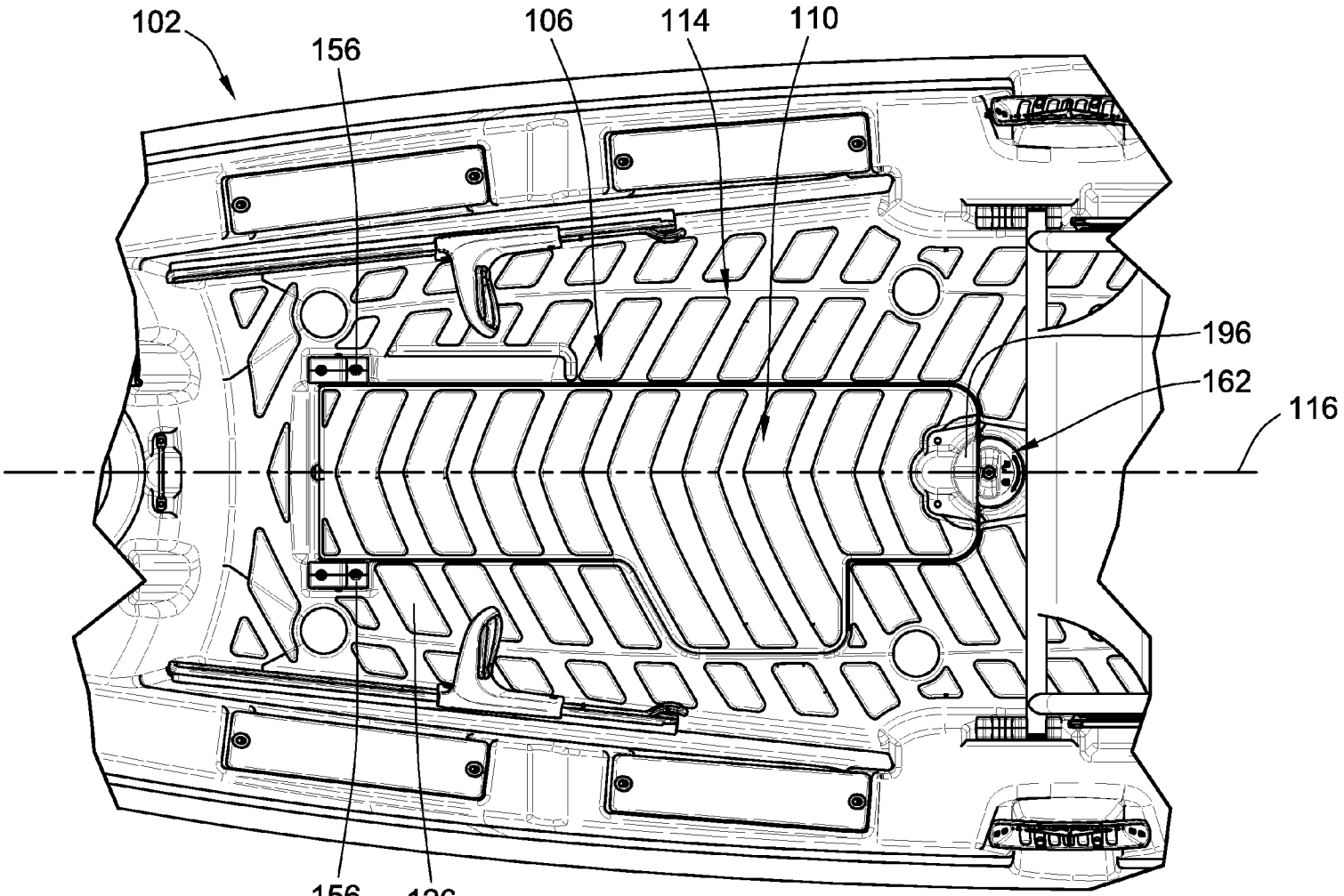
FIG. 17 is an enlarged top illustration of the watercraft having the floor pod mounted in the hull assembly.
Figure 18:
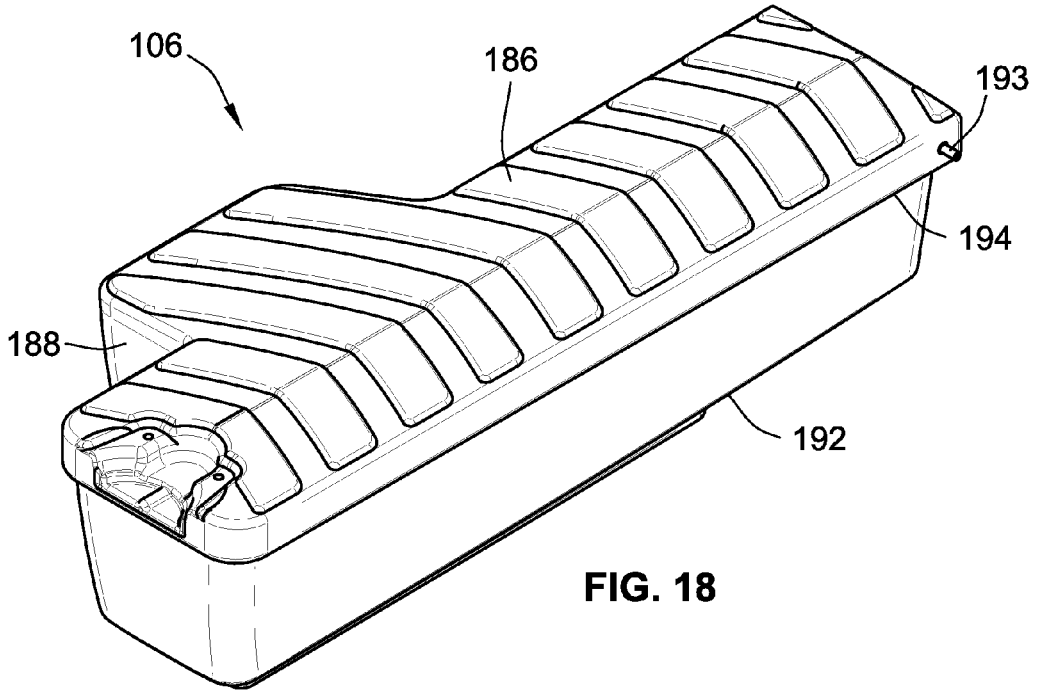
FIG. 18 is a top perspective illustration of the floor pod.
Figure 19:
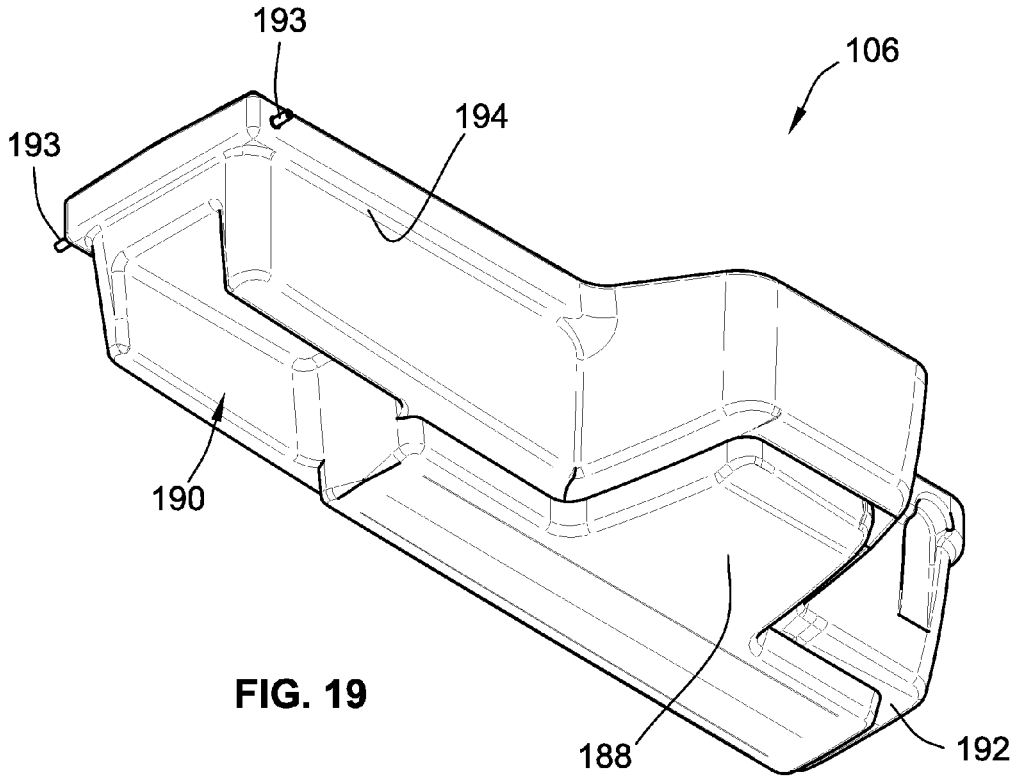
FIG. 19 is a bottom perspective illustration of the floor pod.

FIG. 15 illustrates the floor pod 106 installed in the hull assembly 102. The floor pod 106 fills the pod opening 110 and provides an open floor area 114 forward of seat area 112. The floor pod 106 has a top surface 186 that forms part of the floor and aligns with the top surface 126 of the floor area 114 when mounted in the pod opening 110.

The floor pod 106 is generally a hollow housing (typically formed of plastic) that again matches the shape of the cross-section of the pod opening 110.

Figure 16:
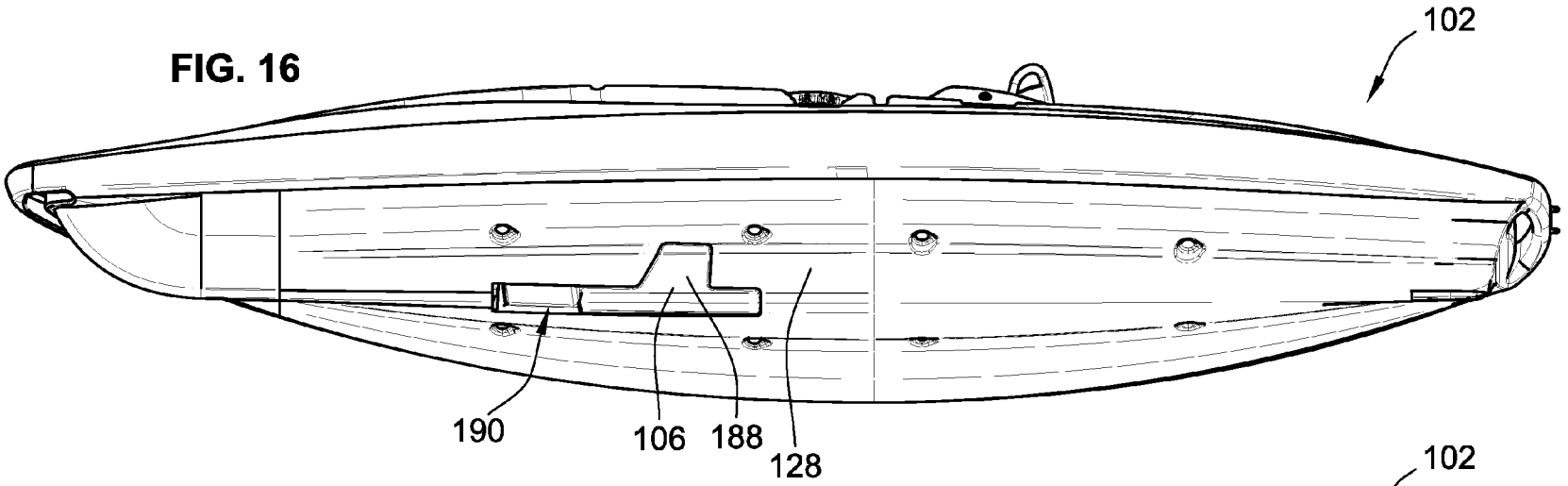
FIG. 16 is a bottom perspective illustration of the watercraft of FIG. 1 having the floor pod mounted in the hull assembly.

With reference to FIG. 16, the floor pod 106 has a bottom surface 188 that generally aligns with the bottom surface 128 of the hull assembly 102. The floor pod 106 includes a recessed cavity 190 on a bottom side proximate a forward end. This recessed cavity 190, again, can accommodate a sensor (e.g. transducer) for a fish or depth finder.

The floor pod mounts to the hull assembly 102 in the same way as the electric motor pod 104 discussed above. More particularly, the floor pod 106 includes pins 191 that cooperate with pin retainers 156. The floor pod 106 also includes shelf portions 192, 194 that cooperate with the shelves 120, 122 of the hull assembly 102 to locate the floor pod 106 and inhibit water ingress. The floor pod 106 also includes shelf portion 196 that cooperates with latch arrangement 162 to secure the floor pod 106 within pod opening 110.

Figure 20:
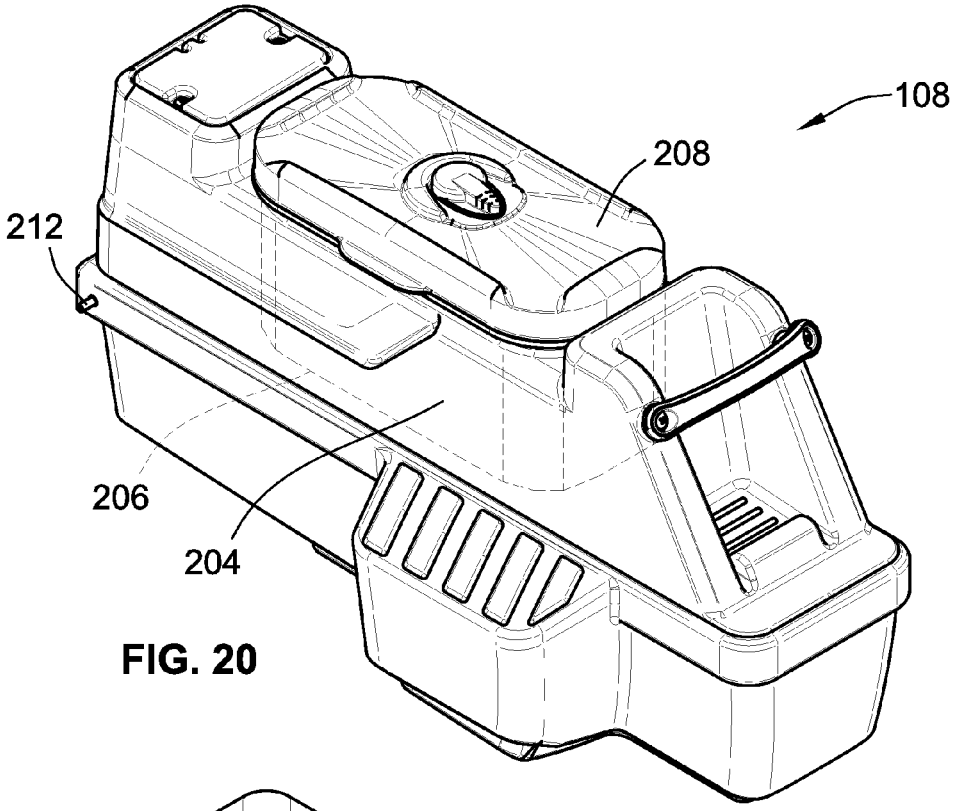
FIG. 20 is a top perspective illustration of the storage pod.
Figure 21:
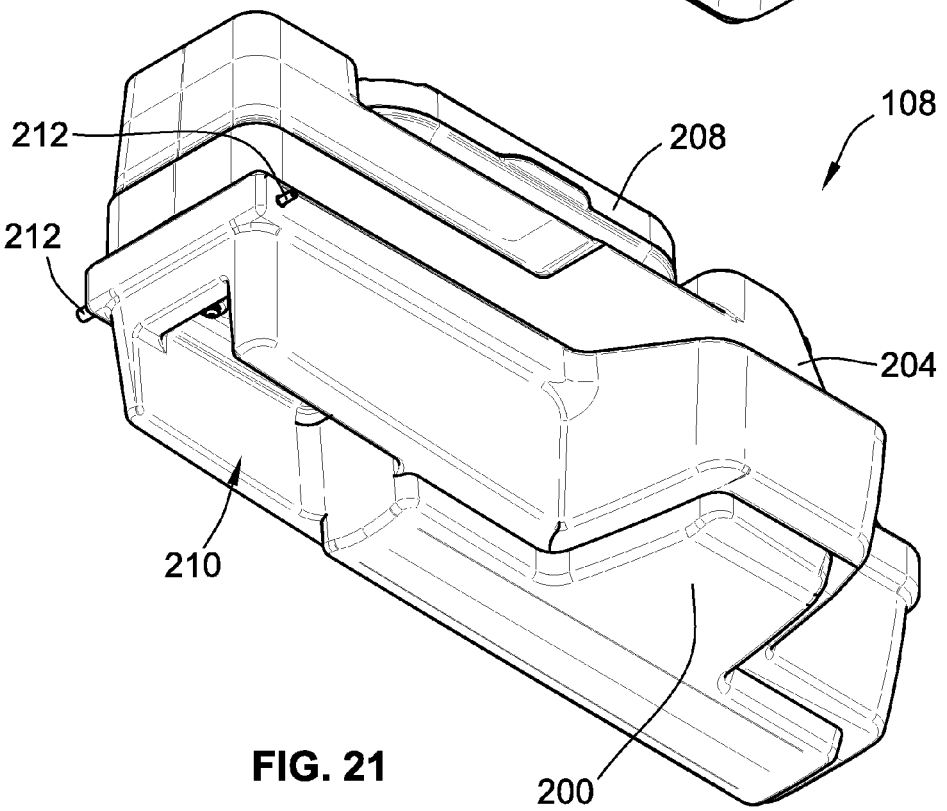
FIG. 21 is a bottom perspective illustration of the storage pod.

FIGS. 20 and 21 illustrate a storage pod 108. The storage pod is similar to the electric motor pod 104 in that it will extend vertically upward from the top surface 126 of the floor area 114 of the hull assembly 102. It is similar to the floor pod 106 in that it has a bottom surface 200 that matches the contours of the bottom surface 128 of the hull assembly 102.

The housing 204 of the storage pod is generally hollow and provides an internal cavity 206 that provides a storage area that is accessible via removable cover 208.

Housing 204 also includes a recessed region 210 similar to the prior pods configured to receive a depth or fish finder transducer or sensor.

The storage pod 108 is mounted to the hull assembly 102 using pins 212 and can be latched in place using latch arrangement 162.

Figure 22:
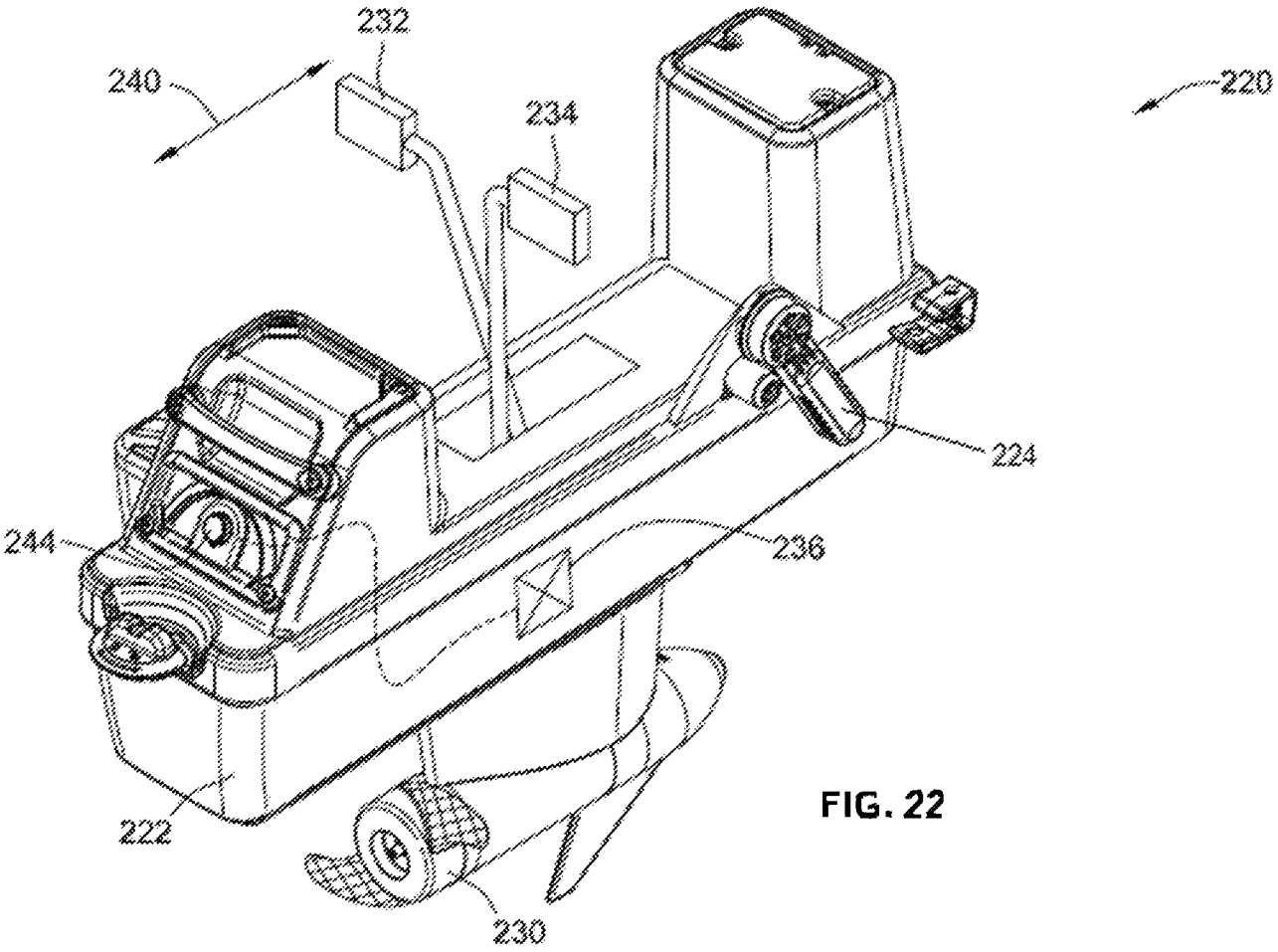
FIG. 22 is a top perspective illustration of the pedal drive pod.

FIG. 22 illustrates a further removable pod for providing propulsion to the watercraft in the form of a pedal drive pod 220. The pedal drive pod 220 includes a housing 222 for mounting in pod opening 110 of the hull assembly 102 in a manner as described above. The pedal drive pod 220 has a prop mechanism including a prop 224 similar to the electric motor pod 104 facilitate moving the pod 220 between two separately fixable positions (i.e. down for propulsion and up for approaching a shore or shallow water).

The pedal drive pod 220 includes a propeller 230 operably coupled to a pair of foot pedals 232, 234 via a transmission arrangement 236. The user can pump the foot pedals 232, 234 in a reciprocating forward-reward motion to drive the propeller 230 to propel the watercraft.

The transmission arrangement 236 may be reversible, such as by external switch 244 to change the direction of rotation of the propeller 230 so as to allow for backing up the watercraft.

Returning to FIG. 1, the watercraft may include a rudder 250 that is operably coupled to foot controls 252. The rudder 250 can be used to control the direction of travel of the watercraft, such as, when the electric motor pod 104 is being used.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular kayak system comprising:

a hull having a seating area and a pod opening extending through the hull, the hull including a removable pod interface arrangement;

a plurality of removable pods, each removable pod configured to be mounted within the pod opening, each removable pod of the plurality of pods being configured such that only a single one of the removable pods is mountable within the pod opening at a time, each removable pod having at least one functional feature different than the other removable pods, each removable pod having a hull interface arrangement configured to cooperate with the removable pod interface arrangement to mount the removable pod within the pod opening;

wherein a first one of the plurality of removable pods is an electric motor pod including a propeller; and wherein a second one of the plurality of removable pods is a floor pod mountable to the removable pod interface arrangement within the pod opening when the electric motor pod is removed from the hull and the removable pod interface arrangement.

2. The modular kayak system of claim 1, further comprising:

an electric power source located remote from the pod opening;

an electric wiring system operably connecting the electric power source to the electric motor pod, the electric wiring system including at least a portion extending within the hull.

3. The modular kayak of claim 2, wherein the electric wiring system includes at least one releasable electrical connector between the electric power source and the electric motor pod to permit disconnecting and reconnecting the electric motor pod to the electric power source.

4. The modular kayak system of claim 1, wherein the electric motor pod, when mounted in the pod opening, is transitionable between a first position and a second position adjusting a position of the propeller with regard to a bottom of the hull.

5. The modular kayak system of claim 4, wherein in the first position the propeller extends bellow the bottom of the hull a further distance than in the second position.

6. The modular kayak system of claim 5, wherein the propeller is located within the pod opening in the second position and at least flush with a bottom surface of the bottom of the hull.

7. The modular kayak system of claim 5, further comprising a prop interposed between the hull and the electric motor pod to secure the electric motor pod in the second position.

8. The modular kayak system of claim 4, wherein the electric motor pod pivots between the first position and the second position.

9. The modular kayak system of claim 1, wherein the pod opening is located in front of the seating area.

10. The modular kayak system of claim 1, wherein the plurality of removable pods includes an electric motor pod including an electric motor with a propeller, a floor pod that has a top surface that generally aligns with a surrounding top surface of a floor of the hull, a pedal drive pod including a pedal drive arrangement for providing pedal powered propulsion, and a storage pod having an accessible internal cavity.

11. The modular kayak system of claim 1, wherein the removable pod interface includes a pin receiving cavity and the hull interface arrangement of at least one of the removable pods includes an outward extending pivot pin configured to mate with the pin receiving cavity and define a pivoting interface therebetween to permit the at least one of the removable pods to pivot between a first position and a second position relative to the hull.

12. The modular kayak system of claim 11, further comprising a locking interface between the hull and the at least one of the removable pods that is pivotable to selectively prevent pivoting motion of the removable pod relative to the hull from the first position to the second position, the removable pod being inserted further into the pod opening in a direction extending from a top of the hull toward a bottom of the hull in the first position than in the second position.

13. The modular kayak system of claim 1, wherein the pod opening is generally elongated in a direction between a front and a rear of the hull, the opening further including a laterally extending recess on at least one side.

14. The modular kayak system of claim 1, wherein the hull includes a stepped interface adjacent the pod opening and at least one of the removable pods includes a cooperating stepped interface that interacts with the stepped interface of the hull when the removable pod is inserted within the pod opening, wherein the stepped interface inhibiting water from passing through the pod opening between the hull and the removable pod.

15. A method of adjusting a position of a propulsion pod of a kayak comprising:

transitioning the propulsion pod of the kayak from a first position wherein a propulsion mechanism is located, at least in part, below a bottom surface of a bottom of a hull of the kayak to a second position wherein the propulsion mechanism is at least flush with and above the bottom surface of the bottom of the hull, transitioning includes pivoting the propulsion pod from the first position to the second position;

securing the propulsion pod in the second position using a prop extending between the propulsion pod and the hull;

wherein the prop is pivotally attached to the propulsion pod for rotation between a first prop position in which the propulsion pod can transition from the second position to the first position and a second prop position in which the prop prevents the propulsion pod from transitioning from the second position to the first position.

16. The method of claim 15, wherein the propulsion mechanism is a rotating propeller.

17. The method of claim 15, wherein the step of securing the propulsion pod in the second position includes rotating the prop from the first prop position to the second prop position.

18. The method of claim 17, wherein rotating the prop from the first prop position to the second prop position includes transitioning the prop through an over-center state such that a weight of the propulsion unit acting on the prop will not bias the prop back toward the first prop position.

19. The method of claim 18, further comprising transitioning the propulsion pod of the kayak from the second position to the first position which includes lifting the propulsion pod prior to transitioning the prop from the second prop position to the first prop position.

20. The method of claim 19, wherein the prop is pivotally attached to the propulsion pod at a first end of the prop and an opposite end of the prop presses against the hull in the second prop position.

21. The method of claim 18, further comprising preventing over rotation of the prop when the prop is rotated from the first prop position to the second prop position using an abutment that engages the prop in the second prop position.

22. The method of claim 15, wherein the propulsion pod is secured in the second position when the prop is rotated from the first prop position to the second prop position.

23. The method of claim 22, wherein rotation of the prop from the first prop position to the second prop position transitions the prop through an over-center state such that a weight of the propulsion unit acting on the prop will not bias the prop back toward the first prop position.

24. The method of claim 23, wherein the propulsion pod must be lifted prior to transitioning the prop from the second prop position to the first prop position to allow the prop to transition from the second prop position to the first prop position.

25. The method of claim 24, wherein the prop is pivotally attached to the propulsion pod at a first end of the prop and an opposite end of the prop presses against the hull in the second prop position.

26. The method of claim 23, further comprising an abutment that engages the prop in the second prop position that prevents over rotation of the prop when the prop is rotated from the first prop position to the second prop position.

27. A kayak comprising: a hull having a bottom defining bottom surface;

a propulsion pod unit mounted to the hull, the propulsion pod transitionable from a first position wherein a propulsion mechanism is located, at least in part, below the bottom surface of the bottom of the hull to a second position wherein the propulsion mechanism is at least flush with and above the bottom surface of the bottom of the hull, the propulsion pod being transitionable from the first position to the second position by pivoting the propulsion pod relative to the hull; and a prop positionable between the propulsion pod and the hull to secure the propulsion pod in the second position, the prop is pivotally attached to the propulsion pod for rotation between a first prop position in which the propulsion pod can transition from the second position to the first position and a second prop position in which the prop prevents the propulsion pod from transitioning from the second position to the first position.

28. The method of claim 27, wherein the propulsion mechanism is a rotating propeller.

* * * * *